United States Patent [19]

Miller

[11] 3,936,126

[45] Feb. 3, 1976

[54] ELECTRICAL CONNECTOR

[75] Inventor: Gregory H. Miller, West Bend, Wis.

[73] Assignee: Dart Industries Inc., Los Angeles, Calif.

[22] Filed: Dec. 7, 1973

[21] Appl. No.: 422,617

[52] U.S. Cl. ..... 339/95 D

[51] Int. Cl.² ..... H01R 9/12

[58] Field of Search ..... 339/95 D, 218 R, 210 M

[56] References Cited

UNITED STATES PATENTS

| | | | |
|---|---|---|---|
| 3,324,447 | 6/1967 | Pistey | 339/95 D |
| 3,393,397 | 7/1968 | Manichl | 339/95 D |
| 3,559,151 | 1/1971 | Gaynor | 339/95 D X |
| 3,569,911 | 5/1971 | Bogdanowicz | 339/95 D |
| 3,585,570 | 6/1971 | Jans | 339/95 D |
| 3,633,148 | 1/1972 | Thorsman | 339/95 D X |
| 3,648,220 | 3/1972 | Julinot | 339/95 D X |
| 3,656,087 | 4/1972 | Nutton | 339/95 D |
| 3,727,174 | 4/1973 | Podmore et al. | 339/210 M |

FOREIGN PATENTS OR APPLICATIONS

| | | | |
|---|---|---|---|
| 1,285,589 | 12/1968 | Germany | 339/95 D |

OTHER PUBLICATIONS

Kolb, D. J.; *Ultrasonic Assembly*, in Machine Design, Mar. 16, 1967, pp. 180–185.

*Primary Examiner*—Joseph H. McGlynn
*Assistant Examiner*—Howard N. Goldberg
*Attorney, Agent, or Firm*—Kenneth J. Hovet; Leigh B. Taylor; Paul R. Wylie

[57] ABSTRACT

An electrical connector adapted to provide a common junction and electrical coupling device for a plurality of conductors, preferably at least four conductors; said electrical connector comprising a box like body of deflectable plastic material, said body having a cover integrally connected therewith by a "living hinge"; and a resilient metallic electrical contact member having a plurality of contact portions all integral with each other; the contact portions having conductor engaging and wedging edges at opposite ends thereof; said edges operable adjacent wall portions of said body which is provided with conductor receiving openings adjacent to said wedging edges whereby electrical conductors may be inserted through said openings and between said wedging edges of said contact portions and respective wall portions of said body; said contact member in its prefered form being substantially H-shaped and having a conductor cross bar portion interconnecting a pair of contact portions, each of which has a pair of opposite ends provided with said wedging edges; the cross bar portion being restrained between projections on said cover and the closed side of said box like body respectively to hold said wedging edges of said contact portions in engagement with conductors to maintain said conductors entrapped in said box like body.

14 Claims, 15 Drawing Figures

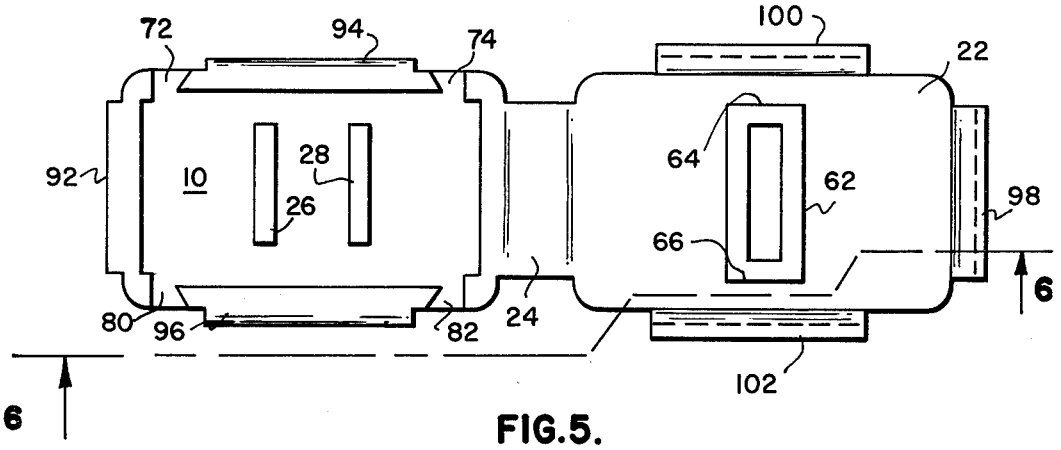
FIG.5.
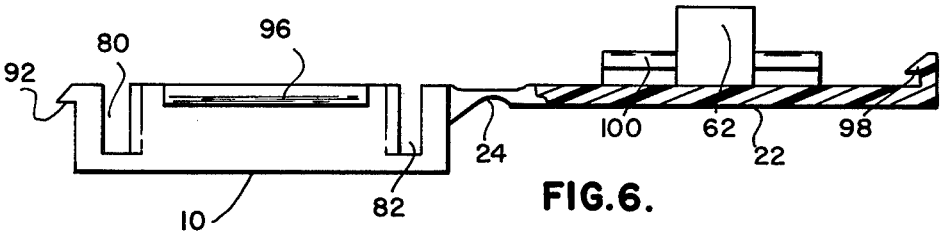
FIG.6.
FIG.7.
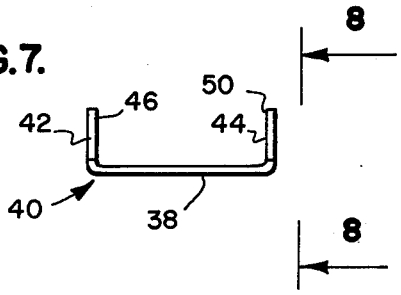
FIG.8.
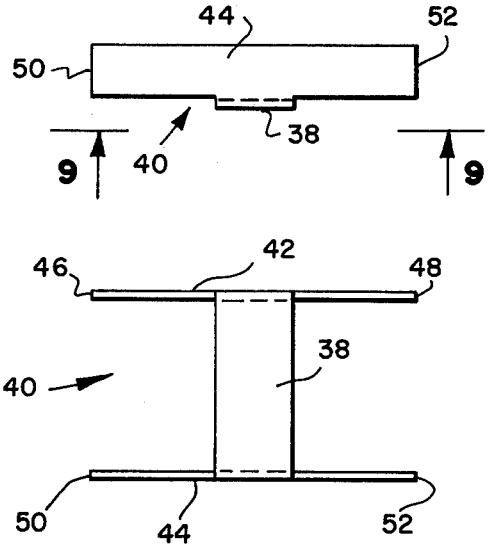
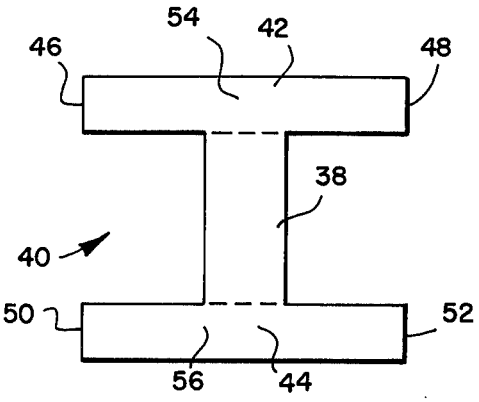
FIG.10.
FIG.9.

ELECTRICAL CONNECTOR

BACKGROUND OF THE INVENTION

Various electrical connectors comprise bodies of various material having openings through which conductors may be inserted into engagement with entrapping contact members. However, most of these electrical connectors provide a common junction for only a pair of wires or conductors, and many of the prior electrical connectors are relatively complicated and expensive in comparison to the number of electrical conductors which may be connected in common. Additionally, many of the prior art electrical connectors are very bulky in proportion to the number of conductors which may be connected in common thereby.

SUMMARY OF THE INVENTION

The present invention comprises a very compact electrical connector having a body and cover molded integrally with each other and interconnected by a living hinge and wherein a single common contact member is adapted to couple at least four electrical conductors in common.

The invention employs a generally H-shaped contact member having a pair of contact portions provided with opposite ends forming wedging edges adapted wedgingly to engage conductors. The contact portions at their intermediate areas being interconnected by a cross bar portion, the contact portions and cross bar portions being flat and the cross bar portion having its flat sides at substantially right angels to those of the contact portions; the cross bar portion being restrained between a pair of projections, projecting from the closed side of the body portion which is generally a box shaped structure; and the cover having a projection adapted to extend between the projections projecting from the closed side of the body portion and holding the cross bar portion of the contact member adjacent to the closed side of the box shaped body and converging openings are provided in the box shaped body adjacent the wedging edges at the ends of the contact portions of the contact member so as to receive electrical conductors which may wedgingly be forced between the wedging edges of the contact portions and a respective adjacent wall of the box shaped body.

The cover for the box shaped body may be fixed to the open side of the body by various means such as ultrasonic welding, riveting, spring clips or other means such as cement or the like. The electrical connector of the invention may be quite compact, as for example, little more than one inch in length and less than one inch in breadth and substantially less than one-half inch in thickness and may at the same time provide a common coupling for at least four electrical conductors. The body of the electrical connector of the invention is substantially rectangular with a substantially rectangular cover integral with the body by means of a "living hinge" and the cover and body are preferably a single casting mold concurrently. The aforementioned H-shaped contact member is particularly suited to a rectangular body wherein opposite ends of the contact portions are deflectably operable adjacent opposite ends of the body while opposite sides of the contact portions are held adjacent to the longitudinal sides of the body by means of a projection carried by the cover of the body, and at the same time, the projection carried by the cover engages a cross bar portion integral with the contact portions of the contact member and the cross bar portion is restrained between projections extending from the closed side of the body portion between which the projection extending from the cover is disposed, whereby the cross bar portion and the contact portions of the contact member are restrained so as to maintain the wedging edges of the contact portions in properly supported position to wedgingly entrap electrical conductors which are extended through converging openings in the side wall portions of the box shaped body of the invention.

The aforementioned openings are adapted to receive electrical conductors and wedgingly to support insulation sheaths of the conductors in the openings, the openings being defined by converging surfaces in the wall portions of the box shaped body.

The box shaped body is provided with a closed side and an open side and the open side is adapted to be covered by means of the integral cover, and the H-shaped contact member is readily and easily assembled in the box shaped body by placing the cross member of the H-shaped contact member between projections extending from the enclosed side of the body whereupon the cover may be hingedly moved into enclosing position over the open side of the body and a projection on the cover forces the cross member portion of the contact member into position between its restraining projections extending from the closed side of the body, whereby the assembly of the electrical connector of the invention is very simple and economically accomplished. The cover is then fixed in relation to the open side of the body so as to enclose the same and may be held in such fixed enclosing position by any one of several means hereinbefore set forth.

Accordingly it is an object of the present invention to provide a very compact, simple and economical electrical connector adapted to provide a common junction for at least four electrical conductors.

Another object of the invention is to provide a body and integral cover connected together by a "living hinge" and adapted to hold a generally H-shaped single piece contact member therein which is adapted to provide a common junction for at least four electrical connectors.

Another object of the invention is to provide an electrical connector which is very simple and economical to produce.

Another object of the invention is to provide an electrical connector which is extremely compact in proportion to the number of conductors for which it provides a common junction.

Further objects and advantages of the invention may be apparent from the following specification, appended claims and accompanying drawings.

BRIEF DESCRIPTION OF THE DRAWINGS

FIG. 5 is a view of the structure shown in FIG. 4 with the body and cover in open position as molded;

FIG. 6 is a fragmentary sectional view taken from a line 6—6 of FIG. 5;

FIG. 7 is an end view of the electrical contact member of the invention;

FIG. 8 is a view taken from the line 8—8 of FIG. 7 of the invention;

FIG. 9 is a view taken from the line 9—9 of FIG. 8;

FIG. 10 is a view of the blank structure of the contact member of the invention before it is finally formed into the configuration shown in FIGS. 7, 8 and 9;

DESCRIPTION OF THE PREFERRED EMBODIMENTS

Figure 1:
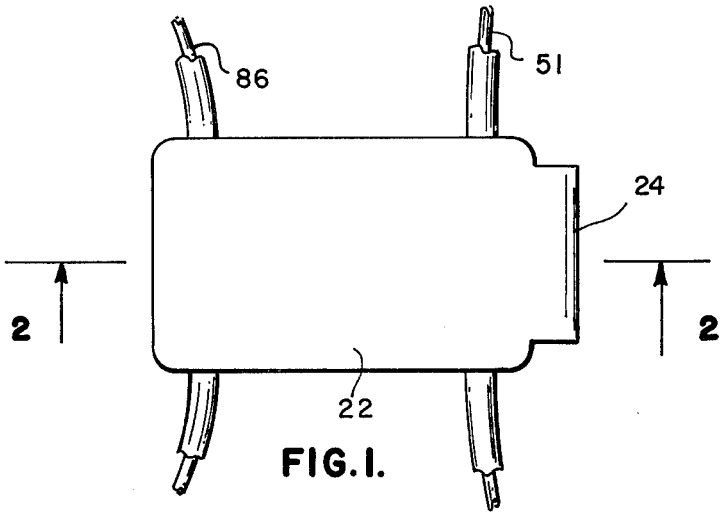
FIG. 1 is an elevational view of the cover side of the electrical connector of the invention.
Figure 2:
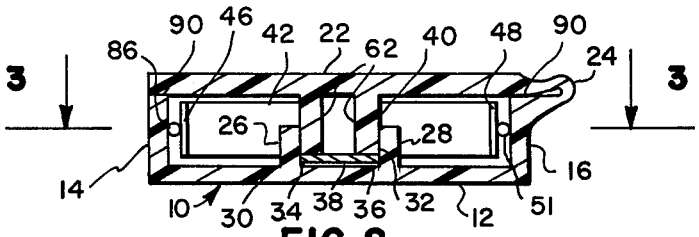
FIG. 2 is a sectional view taken from the line 2—2 of FIG. 1.
Figure 3:
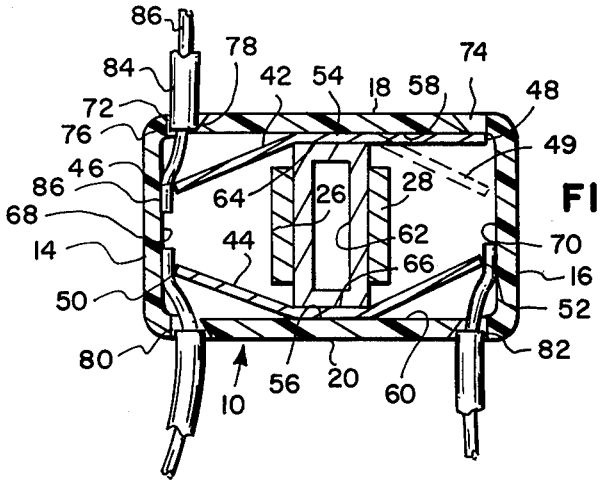
FIG. 3 is a sectional view taken from the line 3—3 of FIG. 2 showing a plurality of electrical conductors entrapped in the electrical connector of the invention and showing one of the contact portions of the electrical connector in its normal position and showing by broken lines the same contact portion in a position in which it may be deflected to entrap an electrical conductor.

As shown in FIGS. 1, 2 and 3 of the drawings, the electrical connector of the invention is provided with a body portion 10 which is generally box shaped in construction and having a closed side 12 with surrounding wall portions 14, 16, 18, and 20. Integral with the body portion 10 is a cover 22 connected to the body portion by a "living hinge" 24. The "living hinge" 24 is molded in interconnected relationship with the cover 22 and body 10 and the entire cover and body structure, preferably molded of deflectable plastic such as polypropylene or the like which is adapted to provide a living hinge such as the hinge 24.

It will be obvious that other materials may be used if desired.

The body portion 10 at its closed side 12 is provided with inwardly directed projections 26 and 28 having inner opposite surfaces 30 and 32 respectively, which engage and restrain opposite edges 34 and 36 of a cross bar portion 38 of a generally H-shaped contact member 40. This generally H-shaped contact member 40 is shown in detail in FIGS. 7 to 10 of the drawings and is provided with contact portions 42 and 44 which are integral with the cross bar portion 38. These contact portions 42 anad 44 are elongated members integral at their intermediate portions with the cross bar portion 38.

THe cross bar portion 38 and the contact portions 42 and 44 are integral with each other and preferably made of resilient metal forming an electrical conductor structure.

The contact portion 42 is provided with opposite ends 46 and 48 which constitute wedging edges adapted wedgingly to engage electrical conductors as will be hereinafter described.

The contact portion 44 is provided with opposite ends 50 and 52 which provide wedging edges adapted to engage and entrap electrical conductors as will be hereinafter described in detail. The herein-before intermediate portions of the contact portions 42 and 44 are designated 54 and 56 respectively and these portions 54 and 56, as shown in FIG. 3 of the drawings, are held in adjacent relationship to an inner surface 58 of the wall portion 18 and an inner surface 60 of the wall portion 20 respectively. These intermediate portions 54 and 56 are so held by means of a projection 62 integral with the cover 22. The projection 62 having surface portions 64 and 66 slightly spaced from the inner surfaces 58 and 60 of the hereinbefore described wall portions 18 and 20. Accordingly, the flat sides of the contact portions 42 and 44 are held between the projection 62 of the cover 22 and the opposite side wall 18 and 20 of the box shaped body 10.

The generally H-shaped contact member thus supported, is restrained at its opposite edges 34 and 36 by the projections 26 and 28 of the body 10; and the flat contact portions 42 and 44 at their intermediate portions 54 and 56 respectively, are held with their planes at substantially right angles to the flat planes of the cross bar portion 38. Additionally, it will be seen that the contact member is so restrained in the body 10 that the conductor engaging and wedging edges 46, 48, 50 and 52 are maintained in resiliently operable relationship to the inner surfaces 68 and 70 of the walls 14 and 16 of the body 10. As referred to in the Claims the wall portions 18 and 20 are described as opposite walls, and the walls 14 and 16 are described as the otther of said walls.

The walls 18 and 20 are provided with conductor receiving openings, the wall 18 having a pair of openings 72 and 74 defined by converging surfaces which are all similar. Accordingly, references made to the conductor receiving opening 72 which is provided with surfaces 76 and 78 which converge inwardly toward the inner side of the body 10, and defining the opening 72 closely adjacent to the wall 68. Likewise the opening 74 is so constructed and also openings 80 and 82 are disposed in the body side wall 20 adjacent the respective walls 14 and 16, all as shown best in FIG. 3 of the drawings. All of the openings 72, 74, 80 and 82, thus are defined by converging walls and these coverging walls are adapted wedgingly to hold a conventional sheath such as the sheath 84 held in the opening 72, the sheath being an insulating sheath covering the respective conductor 86 which is engaged and entrapped by the wedging edge 46 of the contact portion 42, all as shown best in FIG. 3 of the drawings.

The H-shaped contact member 40 provides a common connection or junction for at least four conductors which may be inserted through the opening 72, 74, 80 and 82 hereinbefore described; and when a conductor is inserted through one of these openings, the respective wedging edge such as the edge 48, is disposed in a solid line position as shown in FIG. 3, and is deflected inwardly to a broken line position 49 whereupon the electrical conductor slides past the wedging edge 48 and slides along the inner surface 70 of the wall 16, whereupon the respective conductor is entrapped and if a force is applied tending to retract it, the wedging edge is pivoted toward its respective conductor receiving opening and pivots closer to the respective wall such as the wall 70, thereby squeezing and holding the electrical conductor.

The wedging edges 46, 48, 50 and 52 are quite sharp and the material of which they are made is relatively hard thereby intending to embed in the electrical conductor and frictionally hold it securely entrapped in the body 10.

It will be noted that the wedging edge 48 as shown in FIG. 2 is actually engaged with a conductor 51 in similar fashion to the engagement of the conductor 86 by means of the wedging edge 46 of the conductor portion 42.

The wall portions 14, 16, 18 and 20 are provided with edges at the open side of the body 10, the edges being designated 90 in FIG. 2 of the drawings.

After the H-shaped contact member 40 is placed between the projections 26 and 28 and the cover is in closed position as shown in FIG. 2 of the drawings, ultrasonic welding may be used to fuse the cover to the edges 90 for rendering the entire connector body and cover unitary.

According to a modification of the invention, the body 10 is provided with three buttress ledges 92, 94 and 96 which are cooperable with complimental buttress ledges 98, 100 and 102 respectively. These ledges being deflectable and adapted to snap together and interlock when the cover 22 is pressed into closed position relative to the open side of the body 10.

Figure 4:
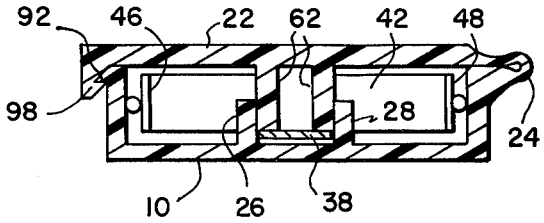
FIG. 4 is a view similar to FIG. 2 showing a modification of the invention for holding the cover and body in fixed and closed position.

Referring to FIGS. 5 and 6 the cover and body may be molded in the position shown therein, both in the preferred form shown in FIGS. 1 to 3 of the drawings or in the modified form shown in FIGS. 4, 5 and 6 of the drawings.

Figure 11:
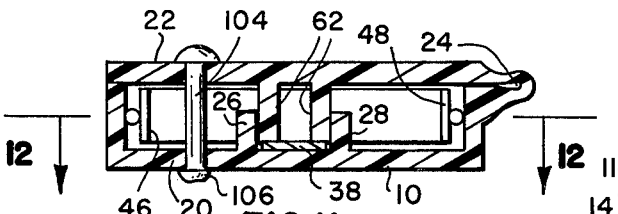
FIG. 11 is a sectional view similar to FIG. 2 showing a modification of the invention wherein a rivet holds the cover and body in closed position.
Figure 12:
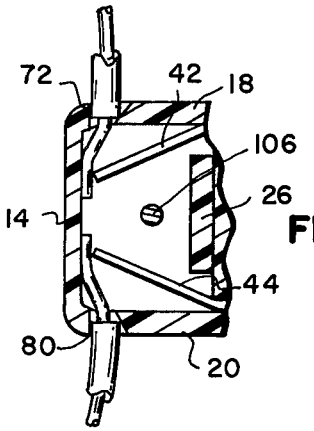
FIG. 12 is a fragmentary sectional view taken from the line 12—12 of FIG. 11.

In the modifications shown in FIGS. 11 and 12, a rivet 104 extends through the cover 22 in the enclosed side 20 of the body 10 for holding the cover in closed position relative to the open side of the body 10. The rivet 104 may be a plastic rivet thermally upset at its end 106 upon assembly and closing of the cover and body into a unitary relationship. As shown in FIG. 12 the rivet 106 is disposed generally centrally of the body between the contact portions 42 and 44 of the contact member 40.

Figure 13:
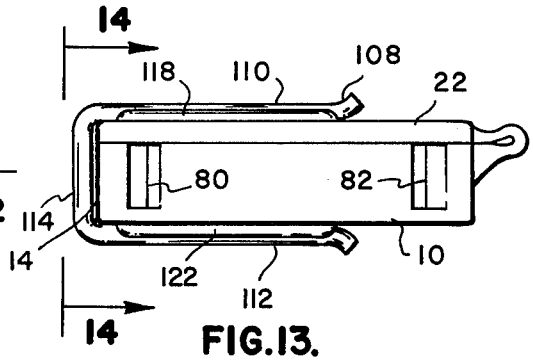
FIG. 13 is a view of the electrical connector of the invention showing a resilient clip member holding the cover and body in enclosed position.
Figure 14:
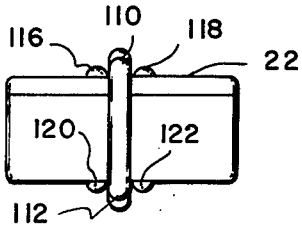
FIG. 14 is a view taken from the line 14—14 of FIG. 13.

In the modifications as shown in FIGS. 13 and 14, the cover 22 is fixed in enclosing position with the open side of the body 10 by means of a spring clip 108 which is a generally U-shaped member having a pair of arms 110 and 112 interconnected by an intermediate portion 114 which is disposed adjacent the body wall 14. The arms 110 and 112 are disposed between a pair of parallel ribs on the cover and the body respectively. The arm 110 being disposed between ribs 116 and 118 on the cover 22 whiled the arm 112 is disposed between ribs 120 and 122 on the enclosed side of the body 10.

Figure 15:
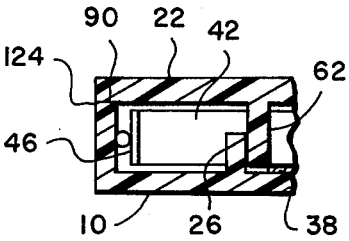
FIG. 15 is a fragmentary sectional view similar to FIG. 2 showing a modification of the invention wherein a cement holds the cover and body in closed position.

In the modification as shown in FIG. 15, the edges 90 of the wall portions of the body 10 are secured to the cover 22 by means of cement 124 which may be any suitable cement as desired for fixing the cover in relationship to the open side of the body 10 for enclosing the same.

It will be obvious to those skilled in the art that various modifications may be resorted to without departing from the spirit of the invention.

I claim:

1. An electrical connector comprising:

a housing and a contact member;

said housing made of plastic material having formable and deflectable character;

said housing having a box like body and a cover;

a hinge structure integral with and interconnecting said body and said cover;

said box like body having an open side and a closed side;

said cover adapted hingedly to be positioned to enclose said open side of said body;

said box like body having wall portions integral with said closed sides;

said wall portions having edges disposed at said open side;

said edges adapted to be contiguous with said cover portion;

said contact member being made of flat resilient sheet metal and having a middle portion provided with generally flat opposite sides and a plurality of generally flat contact portions having opposite sides and being integral with said middle portion, said contact member positioned in said body by a pair of first projections extending from said closed side of said box like body;

said pair of first projections holding said middle portion of said contact member in fixed position adjacent said closed side of said body and thereby preventing substantial movement of said contact member in directions longitudinally of said contact portions;

second projections integral with said cover and disposed between said pair of first projections extending from the closed side of said body;

said second projections holding said middle portion of said contact member adjacent to said closed side of said body;

said contact portions having said opposite sides disposed generally at right angles to said opposite sides of said middle portion;

said body having wall portions substantially parallel with said opposite sides of said flat contact portion;

said contact portions each having a conductor contacting and wedging edge;

a conductor engaging wall portion of said body closely adjacent each wedging edge of each of said contact portions;

said body having a conductor receiving opening in some of said wall portions adjacent each of said wedging edges of said contact portions;

whereby electrical conductors may be inserted through conductor receiving openings and forced between respective wall portions and said wedging edge portions of said conductor portions and whereby resilient character of said contact portions allows said wedging edge portions to be forced into an angular wedging relation to the respective conductors thereby causing wedging entrapment thereof in said body.

2. The invention as defined in claim 1 wherein said first projections comprise a pair of spaced apart projections integral with said closed side of said body and straddle said middle portion of said contact member.

3. The invention as defined in claim 2 wherein said second projections which are integral with said cover are provided with opposite surfaces disposed in closely spaced proximity to respective wall portions of said body; said contact portions of said contact member being held between said opposite surfaces and said respective wall portions of said body.

4. The invention as defined in claim 1 wherein said contact member at said wedging edge portions of said contact portions, being adapted wedgingly to engage and entrap an electrical conductor whereby said integral middle portion of said conductor member conductively couples all of such conductors.

5. The invention as defined in claim 1 wherein said body is provided with converging surfaces in said side walls defining said conductor receiving openings; said coverging surfaces converging inwardly toward the interior of said box shaped body thereby defining inwardly converging openings; said converging surfaces thus adapted to wedgingly hold a conventional insulator sheath of an electrical conductor extending through a respective conductor receiving opening.

6. The invention as defined in claim 1 wherein said cover is fused to said body.

7. The invention as defined in claim 1 wherein said body at said open side thereof is provided with ledge portions; said cover being provided with respective and cooperative interlocking ledge portions whereby said cover is adapted to be snapped closed over the open side of said body.

8. The invention as defined in claim 1 wherein a rivet extends through said cover and said closed side of said body thereby holding said cover contiguous with the open side of said body and enclosing the same.

9. The invention as defined in claim 1 wherein a metal clip straddles said body and said cover thereby holding said cover in contiguous position with the open side of said body and enclosing the same.

10. The invention as defined in claim 1 wherein said cover at the open side of said body is cemented thereto, thereby holding said cover in closed position relative to the open side of the said body.

11. An electrical connector comprising a housing and a contact member;

said housing made of plastic material having formable and deflectable character;

said housing having a box like body and a cover;

a hinge structure integral with interconnecting said body and cover;

said box like body having an open side and a closed side;

said cover adapted hingedly to be positioned to enclose said open side of said body;

said box like body having wall portions integral with said closed side;

said wall portions having edges disposed at said open side;

said edges adapted to be contiguously engaged with said cover portion;

said contact member being made of flat resilient sheet metal and being generally H-shaped with a pair of generally parallel flat and elongated contact portions each having opposite ends and a generally flat cross bar portion integral with said contact portions and disposed between said opposite ends of said contact portions;

said resilient metal contact member positioned in said body by first projections extending from said closed side of said body which hold said cross bar of said contact member in fixed position adjacent said closed side and thereby preventing substantial movement of said contact member in directions longitudinally of said contact portions and second projections which are integral with said cover having opposite surfaces disposed in closely spaced proximity to respective wall portions of said body;

said contact portions of said contact member being held between respective ones of said surfaces and respective wall portions;

said flat cross bar portion having opposite sides;

said flat contact portions having opposite sides disposed at substantially right angles to said opposite sides of said cross bar portion;

said sides of said contact portions being disposed adjacent opposite ones of said wall portions of said box like body;

said opposite ends of said contact portions being disposed substantially at right angles to other ones of said wall portions of said body and in close proximity thereto;

said opposite ones of said wall portions of said body having conductor receiving openings therein;

said openings located near said opposite ends of said contact portions whereby electrical conductors may be inserted through said conductor receiving openings and forced between said opposite ends of said contact portions and respective other ones of said wall portions of said body;

and whereby the resilient character of said contact portions allows said opposite ends thereof to be deflected and forced into an angular wedging relation to the respective conductors thereby causing wedging entrapment thereof in said body.

12. The invention as defined in claim 11 wherein said first projections comprise a pair of projections integral with said closed side of said body and straddle said cross bar portion of said contact member.

13. The invention as defined in claim 11 wherein said contact member at both opposite ends of both of said contact portions each being adapted to wedgingly entrap an electrical conductor whereby said integral cross bar portions conductively couples all of said conductors.

14. The invention as defined in claim 11 wherein converging surfaces of said side wall portions define said conductor receiving openings; said converging surfaces converging inwardly toward the interior of said box like body and said converging surfaces thus adapted to wedgingly hold a conventional insulation sheet of an electrical conductor.

* * * * *